US005697503A

United States Patent [19]

Serres

[11] Patent Number: 5,697,503

[45] Date of Patent: Dec. 16, 1997

[54] SCREENING SIEVES, NOTABLY FOR PAPER PULP

[75] Inventor: Alain Serres, Reims, France

[73] Assignee: E & M Lamort, Vitry Le Francois, France

[21] Appl. No.: 542,012

[22] Filed: Oct. 12, 1995

[30] Foreign Application Priority Data

Oct. 14, 1994 [FR] France ..... 94 12267

[51] Int. Cl.[6] ..... B07B 1/49

[52] U.S. Cl. ..... 209/407; 209/412

[58] Field of Search ..... 209/392, 405, 209/406, 407, 412, 413, 270, 305

[56] References Cited

U.S. PATENT DOCUMENTS

| | | | |
|---|---|---|---|
| 4,236,999 | 12/1980 | Burgess et al. | 209/270 X |
| 5,255,791 | 10/1993 | Lamort | 209/406 |

FOREIGN PATENT DOCUMENTS

| | | |
|---|---|---|
| 354 846 | 8/1988 | European Pat. Off. . |
| 88 10863 | 8/1988 | France . |
| 90/12147 | 10/1990 | WIPO . |

*Primary Examiner*—David H. Bollinger
*Attorney, Agent, or Firm*—Lowe, Price, LeBlanc & Becker

[57] ABSTRACT

Sieve with slots or holes, made from a U-shaped section, constituted by a stack of identical circles, each circle (1, 1') being made from a tapered U-shaped section of which the two ends are welded or mechanically connected to one another, characterized in that this stack of circles (1, 1') is maintained tightly between two rings (2–3, 2–'3') by a plurality of tie rods (4, 4') and in that the lateral walls of the circles in the stack rest on one another without any further fastening together, so that the walls of the sections can undergo elastic deformation under the effects of the tightening.

13 Claims, 5 Drawing Sheets

SCREENING SIEVES, NOTABLY FOR PAPER PULP

European patent No. 0 354 846 filed on Sep. 8, 1989 describes a paper pulp screen and classifier characterized by the juxtaposition of elements of U-shaped cross-section comprising a flat base fitted with perforations and two lateral walls. According to a first embodiment, circles are manufactured and stacked upon one another; according to a second embodiment, the U-shaped section is wound about itself into a spiral.

In both cases the ends of the lateral walls of the "U" must be welded to one another in order to avoid them separating from one another, if only very slightly, under the effects of pressure.

When the sieve must operate centrifugally, the lateral walls of the spirally-wound "U" are turned outwards, as a result of which they can be welded together. Conversely, when the sieve must operate centripetally, the lateral walls of the spirally-wound "U" are turned inwards in which case it is very difficult to carry out welding inside the cylinder thus constituted.

Furthermore, welding all along the spiral path is a costly operation.

However, a fastening device must be provided to avoid partial displacement of the "U" under the effects of the mobile component (commonly referred to as a "foil") which runs along the wall of the sieve in order to cause pressure variations, to ensure perfect parallelism between the two sides of the sieve, and to obtain good rigidity of the sieve in the transversal direction.

Patent application No. WO90/12147 discloses a sieve constituted by a stacking of cylindrical elements in ceramic material between which intercalary rings are disposed, this stacking being maintained assembled by means of tie rods fitted with spring washers.

However, despite the presence of these spring washers, such a sieve is devoid of elasticity due to the fact that the filtering elements are in ceramic and that the intercalary rings are solid.

Experience has shown that, for paper pulp sieves fitted with a mobile device for filter cleaning by pressure variation (commonly referred to as a "foil"), it is preferable that these sieves have a certain elasticity.

The invention relates to a sieve constituted by a stacking of circular elements piled one on top of the other and maintained assembled by a plurality of tie rods parallel to the generating lines of the cylinder, in which each circular element is constituted by a U-shaped section tapered so as to constitute a circle.

Due to the fact that the circular elements are formed from U-shaped elements, the pull exerted by the tie rods will cause, on the one hand, a slight bending of the two branches of the "U" which will come slightly closer together, and, on the other hand, a slight deforming of the base of the "U" which will bulge very slightly.

The stack thus obtained has sufficient elasticity to withstand the pressure variations caused by the foil and to enable the effect of the initial tension imparted by the tie rods to be determined at will.

In addition, the U-shaped elements are fastened without recourse, as was the case previously, to welding or the fitting of a U-shaped wire on the ends of the branches of the "U".

This elasticity and this initial tension, which are sought in order to achieve good resistance to wear of the sieve, nonetheless have a drawback in the case of sieves of large diameter, i.e. of diameter in excess of one meter, insofar as the U-shaped circles slide on one another and the stack of U-shaped circles becomes deformed.

According to another embodiment of the invention, the tie rods are associated with two rings, an upper ring and a lower ring, to constitute a rigid cylindrical frame onto which the U-shaped circles are slipped; the initial tension of said circles being achieved by tightening another ring on the stack.

Further features and advantages of the invention will be apparent from the following description of the invention given, by way of a non-limiting example, in reference to the corresponding accompanying drawings in which:

FIGS. 1 and 2 represent a sieve of a known type, as described in patent No. 88.10863 dated Dec. 8, 1988.

In reference to these figures, it can be seen that to produce a sieve, the section used has a U-shaped profile of which the base is bored with either slots or holes.

The U-shaped section thus prepared is then tapered, after which it is either wound into a spiral or cut into pieces of equal length in order to make circles which are stacked upon one another.

When the sieve is intended for centrifugal use (i.e. when the substance to be filtered is introduced inside the cylinder), the U-shaped section is disposed so that the two lateral walls of the "U" are turned outwards. Conversely, when the sieve is intended for centripetal use (i.e. when the substance to be filtered circulates from the exterior towards the interior), the lateral walls of the "U" are turned inwards.

In both cases, it is imperative that the convolutions of the U-shaped section be fastened to one another.

In the first case, when the lateral walls of the "U" are turned outwards, they can be fastened to one another by means of a clamp or a weld seam. However, this additional operation is costly.

In the second case, it so happens that it is very difficult to weld a seam inside the cylinder thus formed and it is practically impossible to insert a clamp.

According to the invention, the U-shaped sections are used to make circles of same diameter. To this end, the U-shaped sections are either tapered so as to obtain several windings, with lengths then being cut off to enable the forming of circles of the required diameter; or the U-shaped section is cut into sections of same length which are then tapered to form a circle.

When the circle has been shaped, the two ends of the section are welded together, thus enabling a rigid circle to be obtained.

Figure 2:
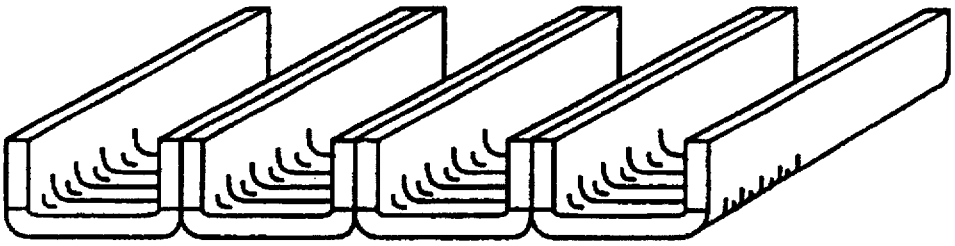
FIG. 2 is a cutaway view of U-shaped sections used to constitute the sieve in FIG. 1.
Figure 1:
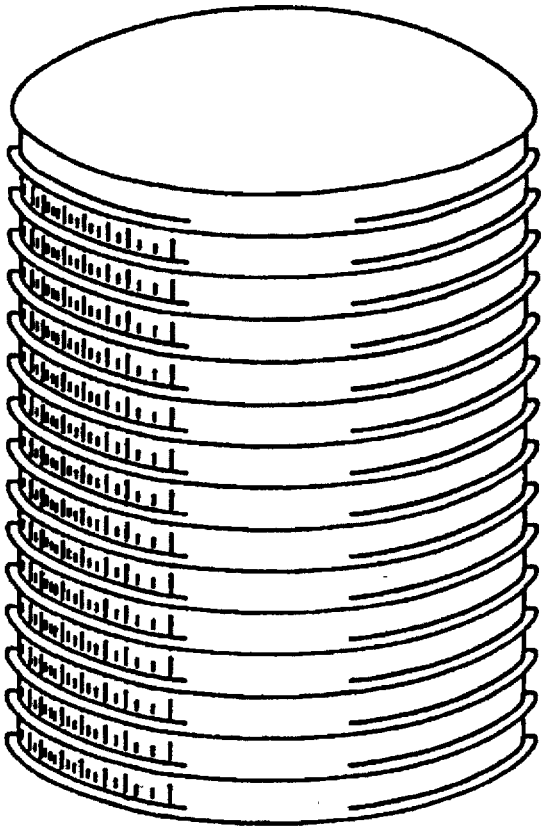
FIG. 1 is a schematic view of a sieve of a known type.
Figure 3:
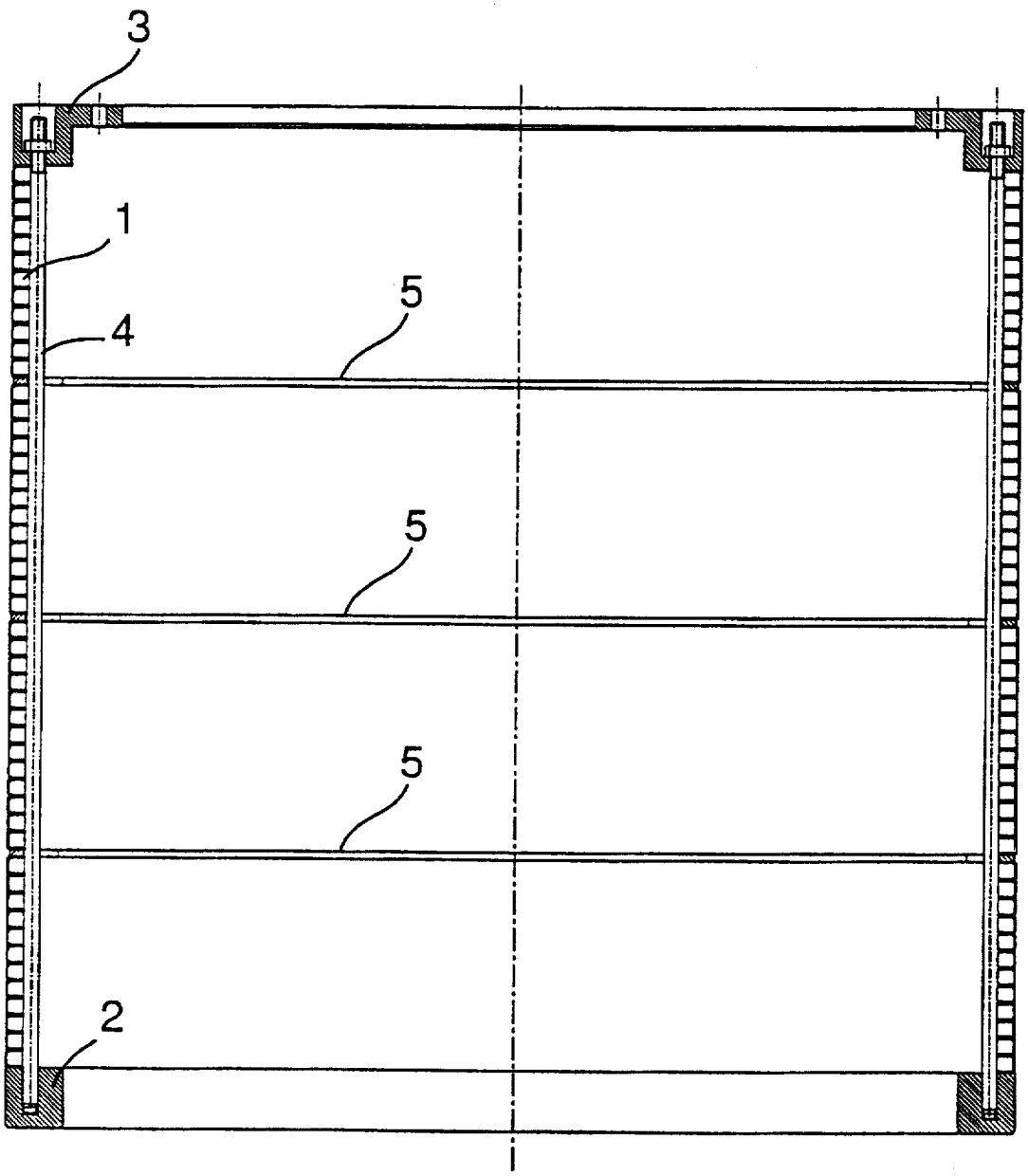
FIG. 3 shows a first embodiment of the invention.
Figure 6:
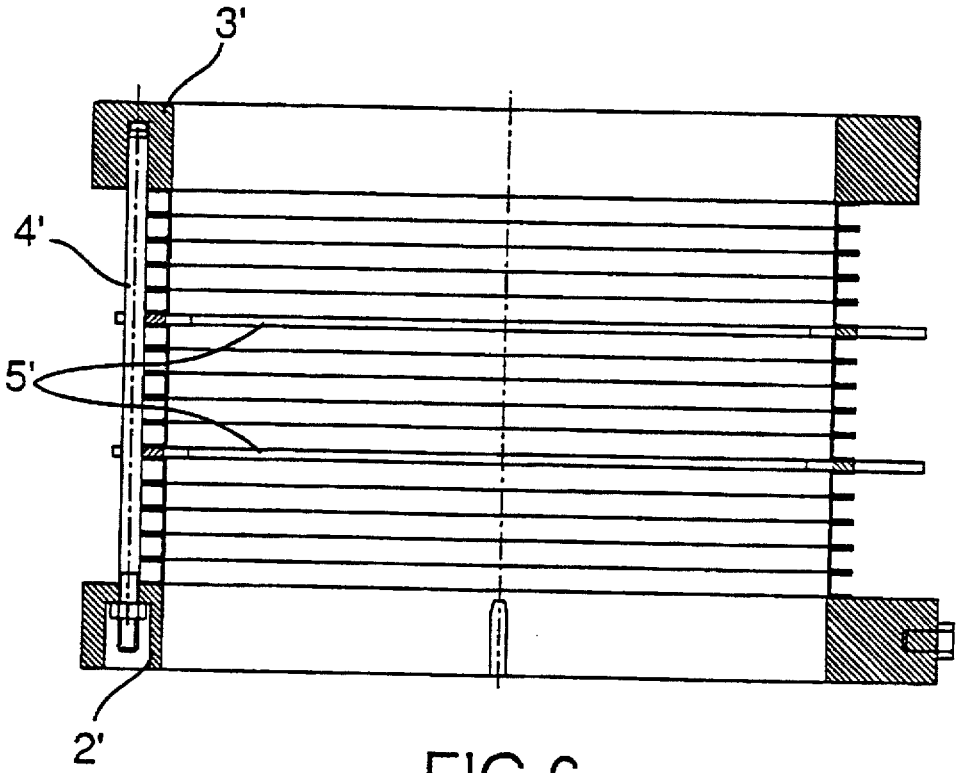
FIG. 6 shows a second embodiment of the invention.

Depending on the direction in which each section is curved, a circle 1 is obtained in which the lateral walls of the "U" are turned inwards, as represented in FIG. 3, or a circle 1' is obtained in which the lateral walls of the "U" are turned outwards, as represented in FIG. 6.

The circles thus obtained are then stacked upon one another.

In order to keep them tightly together, a ring 2 is disposed at the base of the stack and another ring 3 is disposed on the top.

Several tie rods 4 are disposed between the rings 2 and 3.

These tie rods 4 are threaded at both ends in order to receive nuts 6 enabling sufficient tightening to maintain the circles against one another without play during operation.

In the example represented in FIG. 3, each tie rod 4 is screwed into the lower ring 2 and is fitted with a nut 6 at its upper end; however, it is possible to place a nut 6 at each end, in which case the two rings 2 and 3 are then identical.

Figure 4:
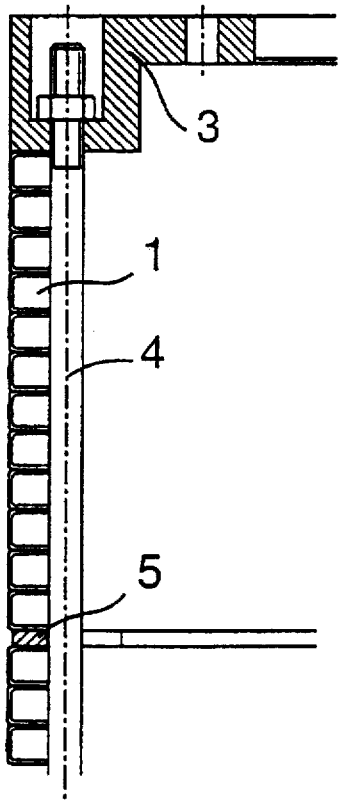
FIG. 4 is a larger-scale partial view of FIG. 3.

In the case of FIGS. 3 and 4 which represent a sieve intended for centripetal use, it is preferable that there be as few obstacles as possible at the exterior surface of the sieve: the tie rods 4 are then disposed inside the sieve.

Figure 5:
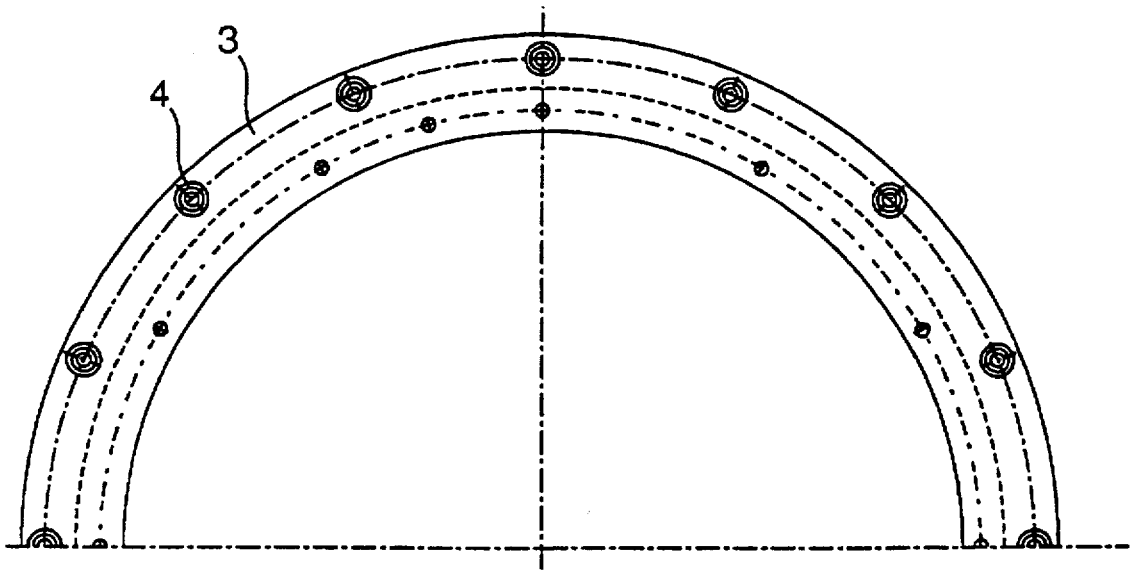
FIG. 5 is a top view of the sieve in FIG. 3.
Figure 7:
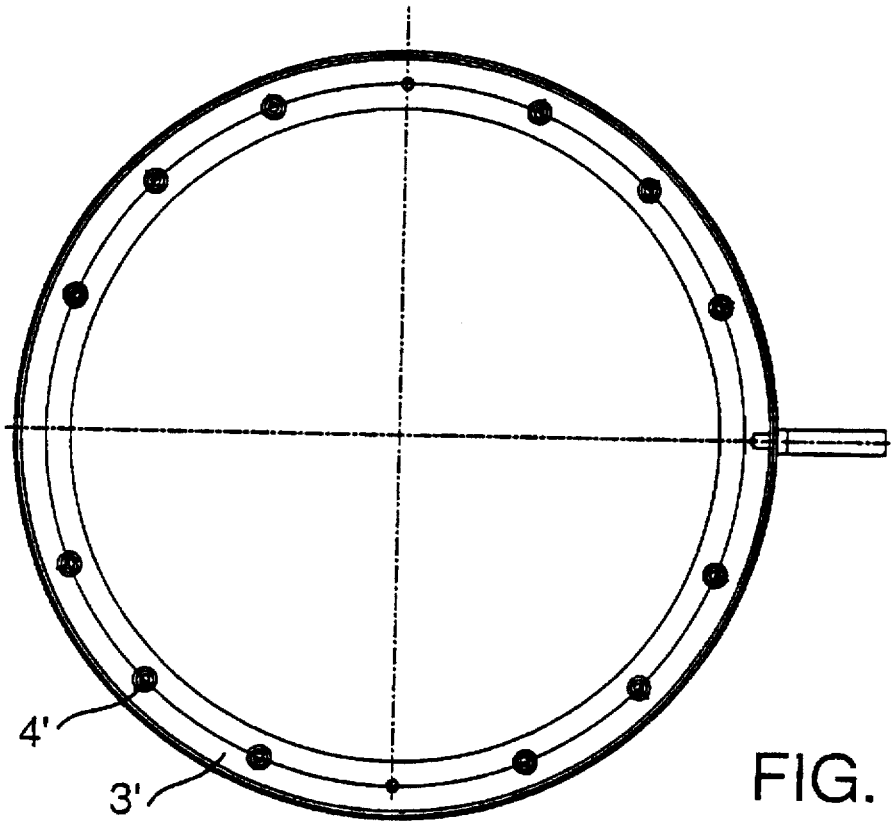
FIG. 7 is a top view of the sieve shown in FIG. 5.

In the case of FIGS. 5 and 6, it is the inner wall of the sieve that must be devoid of any obstacle, as a result of which the tie rods 4' must then be situated on the exterior.

In both cases, in order for the stack of circles to be stable, it is preferable that rings 5 be inserted at regular intervals.

This arrangement is particularly advantageous:

- it so happens that circles are easier and less costly to manufacture than spirals;
- there is much less welding required, as there is only one weld seam per circle instead of a weld seam all along the spiral;
- centrifugal sieves are just as easy to manufacture as centripetal sieves;
- the suppression of weld seams avoids deformation and local embrittlement problems caused by welding;
- this enables the assembly time to be reduced considerably and makes it possible to group together sieve assembly and final dimensional inspection operations.

Most importantly, however, this enables the "U"s to be stacked rigidly and yet with a certain elasticity.

In fact, as previously mentioned, under the effects of the pull exerted by the tie rods 4, the "U"s will tend to undergo elastic deformation, with the two branches of the "U" coming slightly closer together and the base of each "U" bulging slightly.

This elasticity enables a given initial tension to be applied with precision, something that is not possible with the stack disclosed in prior patent Ser. No. WO90/12147, and each sieve can thus be adapted to the pressure variations to which it will be subjected in operation.

This relative elasticity is a major advantage, but comprises a drawback for sieves of large diameter, i.e. sieves of diameter exceeding one meter.

In this case the U-shaped circles inevitably slide on one another.

Such sliding cannot occur with the elements in prior patent Ser. No. WO90/12147 because the elements comprise notches that nest into grooves; it is not, however, possible to make such notches on the walls of the U-shaped sections.

Figure 8:
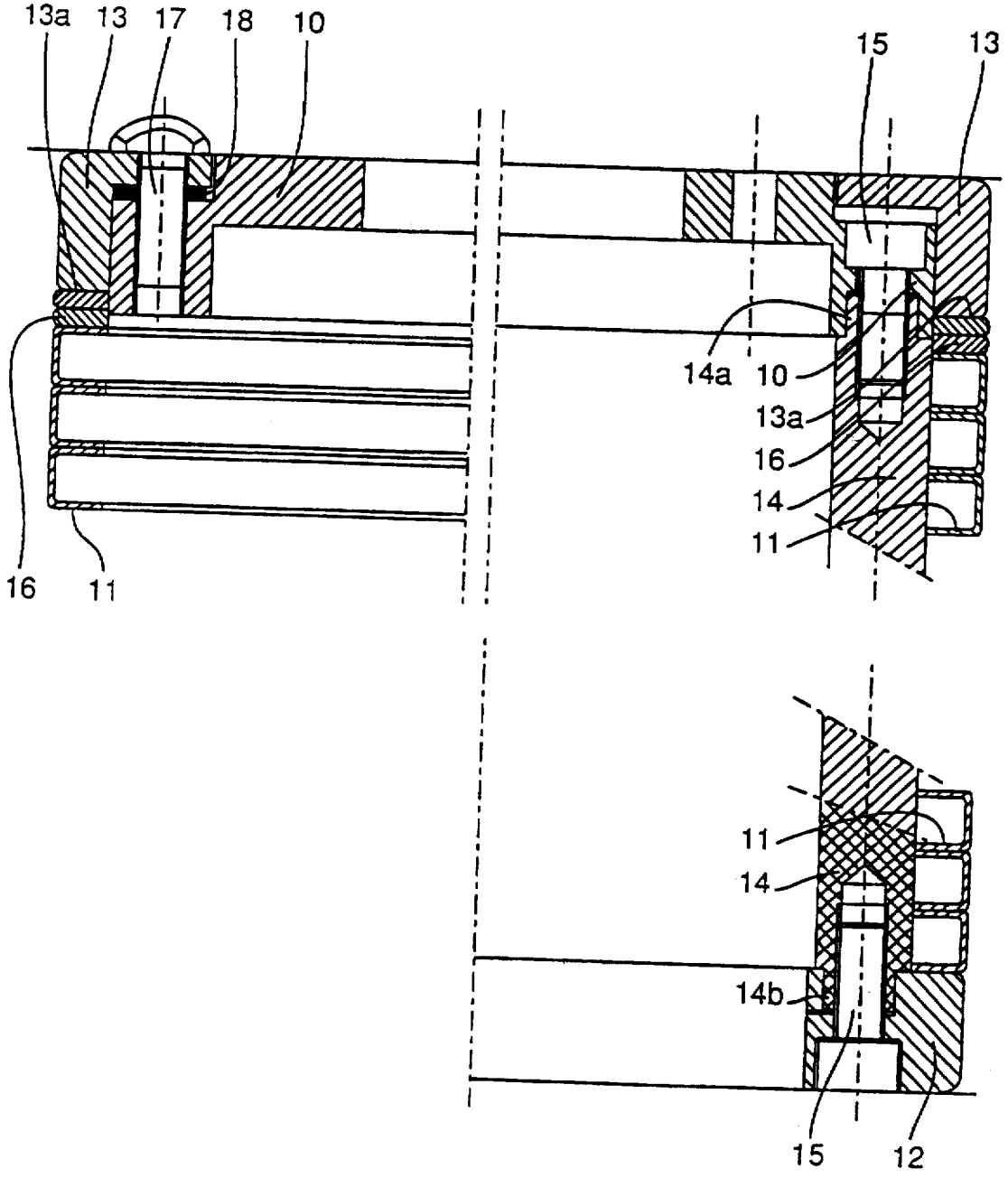
FIG. 8 is a partial view illustrating the assembly and tensioning of the U-shaped circles for a centripetal sieve of large dimensions.

According to the invention and as illustrated in FIG. 8, tie rods are used not to tighten the "U"s against one another but to constitute, in cooperation with two rings, a rigid cylindrical frame onto which the "U"s are slid one after another. The elastic tightening with initial tension of the "U"s then takes place by means of an additional ring, called nip ring, which is screwed with precision onto said rigid frame.

In reference to FIG. 8, the rigid cylindrical frame can be seen to be made with bars 14 which are solidly fastened, by means of screws 15, to an upper ring 10 and a lower ring 12. The two rings 10, 12 and the bars 14 thus form a sort of solid cage. In order to improve the rigidity of the assembly, the ends **14*a* and 14*b* of the bars 14 fit into corresponding housings arranged in the rings 10 and 12**.

The U-shaped circles 11 are then slid onto the cage thus formed. Obviously, the dimensions of the rings 10, 12 and bars 14 are determined so as to correspond to the inside diameter of the U-shaped circles 11.

A ring 13 is then positioned on the U-shaped circle on top of the stack and this ring 13 is tightened by a plurality of screws 17 onto the upper ring 10. The lower side **13*a* of the ring 13 thus exerts a nip pressure on the stack of circles 11**.

Preferably, one or more wedges 16 are placed between the lower side **13*a* of the nip ring 13 and the first circle 11**.

Also preferably, washer-shaped wedges 18 are placed between the nip ring 13 and the upper ring.

Thus, by way of the wedges 18, it is possible to precisely determine the tightening stroke of the ring 13 onto ring 10 and therefore, taking into account the thickness of the wedges 16, the exact value of initial tension to which the stack of circles 11 in U-shaped section is subjected.

The invention is not, of course, limited to the embodiment as described in FIG. 8 which is only disclosed by way of an example; all other embodiments of a rigid structure onto which the circles 11 in U-shaped section are slid also come within the scope of this invention.

I claim:

1. Sieve with slots or holes, constituted by a stack of identical circles, each circle (1, 1') being made from a tapered U-shaped section of which the two ends are welded or mechanically connected to one another, characterized in that this stack of circles (1, 1') is positioned between two rings (2–3, 2'–3') disposed at opposite ends of the stack of circles, and a plurality of tie rods (4, 4') extend between and are connected to the rings to maintain them in tight engagement with the stack of circles, whereby the lateral walls of the circles in the stack rest on one another without any further fastening together, so that the walls of the sections can undergo elastic deformation under the effects of the tightening of the connection between the tie rods and the rings.

2. Sieve as claimed in claim 1, wherein at least one intermediary ring (5) is disposed between two circles in the stack.

3. Sieve as claimed in claim 2, wherein rings (5) are inserted at regular intervals between the circles in the stack.

4. Sieve as claimed in claim 1 wherein the U-shaped sections of the circles comprise lateral walls that extend inwardly, and the tie rods (4) are disposed on the inside of the circles, for centripetal operation.

5. Sieve as claimed in claim 1 wherein the U-shaped sections of the circles comprise lateral walls that extend outwardly, and the tie rods (4') are disposed on the outside of the circles, for centrifugal operation.

6. Sieve as claimed in claim 1, characterized in that the tie rods (4) are threaded at both their ends and receive nuts (6) enabling sufficient tightening to maintain the circles against one another without play during operation.

7. Sieve as claimed in claim 1 characterized in that the tie rods (4) are threaded at both their ends, are screwed at one end into one ring (2) and are fitted with a nut (6) at their other end in cooperation with the other ring (3).

8. Sieve as claimed in claim 1, characterized in that there is a rigid cylindrical structure onto which the U-shaped circles (11) are slid one on top of the other.

9. Sieve as claimed in claim 8, wherein the rigid cylindrical structure is comprised of an upper ring (10) and a lower ring (12) connected rigidly together by a series of bars (14), the dimensions of the rings (10–12) and bars (14) being determined so as to correspond to the inside diameter of the circles (11).

10. Sieve as claimed in claim 9, wherein a nip ring (13) rests, by means of its lower side (13*a*), on the top circle 11 and is tightened onto the rigid cylindrical structure (10, 12, 14) by a plurality of fastening screws (17).

11. Sieve as claimed in claim 10, in which adjusting wedges (16) are interposed between the nip ring (13) and the first circle (11) made from a U-shaped section.

12. Sieve as claimed in claim 11, wherein the adjusting wedges (18) are interposed between the nip ring (13) and the upper ring (10) of the rigid structure.

13. Sieve as claimed in claim 12, wherein rigid circles are interposed between circles spread over the height so as to improve the rigidity of the assembly.

* * * * *